US010351296B2

(12) United States Patent
Birchmeier

(10) Patent No.: US 10,351,296 B2
(45) Date of Patent: Jul. 16, 2019

(54) HINGED CONTAINER

(71) Applicant: Georg Utz Holding AG, Bremgarten (CH)

(72) Inventor: Bettina Birchmeier, Stetten (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 673 days.

(21) Appl. No.: 14/771,904

(22) PCT Filed: Feb. 26, 2014

(86) PCT No.: PCT/IB2014/059255
§ 371 (c)(1),
(2) Date: Sep. 1, 2015

(87) PCT Pub. No.: WO2014/132195
PCT Pub. Date: Sep. 4, 2014

(65) Prior Publication Data

US 2016/0009445 A1 Jan. 14, 2016

(30) Foreign Application Priority Data

Mar. 1, 2013 (CH) ..... 0529/13

(51) Int. Cl.
*B65D 6/18* (2006.01)
*B65D 21/02* (2006.01)
*B65D 21/08* (2006.01)

(52) U.S. Cl.
CPC ..... *B65D 11/1833* (2013.01); *B65D 21/0209* (2013.01); *B65D 21/086* (2013.01)

(58) Field of Classification Search
CPC ..... B65D 11/1833; B65D 21/0209; B65D 21/086

(Continued)

(56) References Cited

U.S. PATENT DOCUMENTS 5,501,354 A * 3/1996 Stromberg ..... B65D 1/225 220/7
5,588,549 A * 12/1996 Furtner ..... B65D 11/1833 220/4.28

(Continued)

FOREIGN PATENT DOCUMENTS

| | | | |
|---|---|---|---|
| EP | 1477414 | A1 | 11/2004 |
| EP | 2500290 | A1 | 9/2012 |
| WO | 0068101 | A2 | 11/2000 |

OTHER PUBLICATIONS

International Search Report for PCT/IB2014/059255 dated Feb. 6, 2014.

*Primary Examiner* — Andrew T Kirsch
(74) *Attorney, Agent, or Firm* — McCormick, Paulding & Huber LLP

(57) ABSTRACT

A foldable container features a base and four lateral walls, with the lateral walls featuring trailing edges with latching elements and one or more ridges that extend from the trailing edge on the internal surface and/or close to the external surface and on lateral edges of the side wall. During stacking, the ridges mesh either between the latching elements and/or between two additional ridges so that stacked containers cannot shift in longitudinal direction. The trailing edges are designed in a step like shape and feature a protruding edge, by means of which a shifting in diagonal direction is also prevented. According to the invention, the containers are deformed less during transport and are easier to fold together. The invention facilitates stacking and folding by robots.

8 Claims, 5 Drawing Sheets

(58) Field of Classification Search
USPC ..... 215/254; 220/6, 265
See application file for complete search history.

(56) References Cited

U.S. PATENT DOCUMENTS

| | | | | |
|---|---|---|---|---|
| 5,746,342 | A * | 5/1998 | Jacques ..... | B65D 11/1833 220/6 |
| 2011/0108558 | A1 | 5/2011 | Magni et al. | |

* cited by examiner

HINGED CONTAINER

CROSS REFERENCE TO RELATED APPLICATIONS

This application is entitled to the benefit of and incorporates by reference essential subject matter disclosed in International Patent Application No. PCT/IB2014/059255 filed on Feb. 26, 2014 and Swiss Patent Application No. 00529/13 filed Mar. 1, 2013.

TECHNICAL FIELD

The invention relates to a foldable container, whose lateral walls are folded outward in an open unfolded flat condition.

STATE OF THE ART

Such a container is for example known from U.S. Pat. No. 5,746,342. This describes a foldable container for bottles, whose walls are folded outward from its base in a first condition and are brought into a usable final condition by positioning of the lateral walls by means of hinges along the base edges. Latching devices are affixed on the lateral trailing edges of the lateral walls, which facilitate a fixation of the lateral walls that are positioned at right angles to each other. The latching devices are designed with elastic elements for latching of the lateral walls in their upright position. The lateral walls have flat elements on each of their bottom edges that prevent an inward folding of the lateral walls. Projections are arranged on the lateral side of the base of the container and notches are arranged on its medial side, which interlock during stacking of open folded containers.

Containers for storage and transportation of goods are preferably positioned in a number of rows and stacking levels. Recently, such containers are increasingly only moved by robots. The use of lift trucks or even manual labor is eliminated in such installations, which also eliminates the need for access spaces to individual stacks of containers. In other words, the stacks of containers can be stacked and arranged to completely filled capacities. In order to guarantee the stability of such stacks as well as correct gripping and moving as well as ensuring the replacement of containers by robots, an exact and correctly aligned stacking of such containers is necessary.

SUMMARY OF THE INVENTION

This is an object of the invention. The invention relates to a foldable container with a base and four movable lateral walls connected to the base, which can be stacked and transported in a flattened, outwardly open unfolded condition and which can be closed before its use as container by swiveling the lateral walls inward from the outside, bringing them into a vertical position and interlocking them with each other. Each of the lateral walls features an outside and inside surface and two lateral edges as well as a top edge and a bottom edge, with the outside surface and the inside surface of the lateral walls positioned in the exterior side and the interior side of the container respectively in their final vertical condition and with the top edge running along the open end of the container. In addition, the container features hinges at the bottom edges of the lateral walls, by means of which the lateral walls can be folded upward from a horizontal position and flat orientation with the base and brought into a vertical position. The lateral trailing edges feature latching elements for fixation of the upward folded lateral walls that are positioned at right angles to each other. According to the invention, the container features on the lateral edges of at least two lateral walls opposite each other a step shaped edge exhibiting a cantilever arm overhanging from the inside surface of the lateral walls and an edge protruding vertically from the inside surface of the lateral wall with one or more protruding latching elements arranged on this protruding edge. In addition, the container features either one or more ridges that extend vertically from the overhanging cantilever arm of the lateral wall and extend away from the lateral edges of the lateral wall or the container features one or more ridges that extend away from the overhanging cantilever, wherein some of the ridges extend at right angles to the inside surface of the lateral wall and other ridges extend away from the lateral edges of the lateral walls.

If a first container in its open unfolded, flat condition is stacked onto another second container, the one or more ridges of the first container engage next to the latching element between the latching devices of the second container so that the two containers are locked in their places and cannot shift relatively to each other. The ridges thus enable correct vertical stacking of multiple containers that wind up correctly positioned on top of each other.

The ridges are butt-jointed on one side to the protruding edge, which prevents shifting in parallel direction to the upper edge of the lateral wall. On the other side, the ridges are butt-jointed to the latching elements, which prevents a shifting in diagonal direction or in parallel direction to the protruding edge or the lateral edge of the lateral wall. During transport, the container walls are better protected against deformation and other stresses by the fixed stacking so that the lateral walls are as straight as possible when the containers are folded for their use as finished containers and so that the folding and interlocking can be performed as flawlessly as possible.

The aligned, vertical orientation of the stack of flat containers also allows safe, accurate gripping of the containers by a robot. Even the folding and interlocking can be performed by a robot due to the integrity of the lateral walls.

In one embodiment of the invention, the at least one latching element at the protruding edge of the lateral wall and the at least one ridge is attached to the lateral edges of the lateral wall and thus to that surface that is turned away from the surface of the lateral wall with the latching element. It therefore extends away from the latching element. The ridge is in particular positioned in an area next to a latching element or in the area between two latching elements.

In one embodiment of the invention, the latching elements are arranged on the protruding edge and extend parallel to the internal surface of the lateral wall, with the one or more ridges arranged on the opposite external surface of the lateral wall and with one length and width equal to or approximately equal to the length and width dimensions of a latching element.

In another embodiment of the invention, instead of or in addition to the previously described ridges, one or more ridges are arranged on the overhanging cantilever arm and on the internal surface of the lateral wall and one or more ridges are arranged on the lateral edges of the lateral wall. The ridges on the overhanging cantilever arm and on the lateral edges of the lateral wall are in particular arranged close to one another but offset to one another. They are expediently arranged this close to one another so that the ridges of two containers can easily mesh during stacking and that the range of movement or the possible shifting of the containers relative to each other is minimized as much as possible.

In one embodiment of the invention, the ridges on the lateral edges of the lateral wall are tapered in direction of the trailing edge of the lateral wall. They are for example designed beveled or display a round or angular notch.

During stacking of unfolded containers of this design, the ridges on the internal surface mesh between the ridges on the lateral edges of the lateral wall so that a shifting in parallel direction to the edge of the lateral wall is made impossible.

In one embodiment of the foldable containers according to the invention, the hinges for the swiveling of the lateral walls of the container with a swivel range are designed for positioning of the lateral wall of up to 10° beyond the vertical position into the interior of the container.

This also allows fabrication of the container from firm, rigid plastic material and assembly of the container by hand or by a robot. Since the lateral walls can swivel beyond the vertical position, hooking and latching of the firm lateral walls that are at right angles to each other is facilitated in their rigid shape. As such, the containers can also be picked up, folded and interlocked by a robot and can thus be brought into their usable end condition.

Additional advantages of the invention result from the following description, in which the invention is explained in more detail by means of embodiment examples displayed in schematic drawings.

BRIEF DESCRIPTION OF THE FIGURES

The same reference signs are always used for the same elements in the figures and the initial explanations apply to all figures if not expressly indicated otherwise.

DETAILED DESCRIPTION OF EMBODIMENTS OF THE INVENTION

Figure 1:
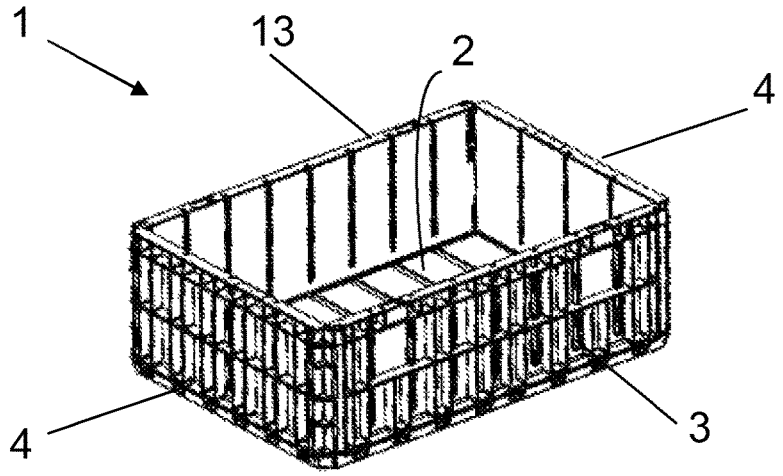
FIG. 1 shows a perspective view of an operational container in accordance with the invention.
Figure 2:
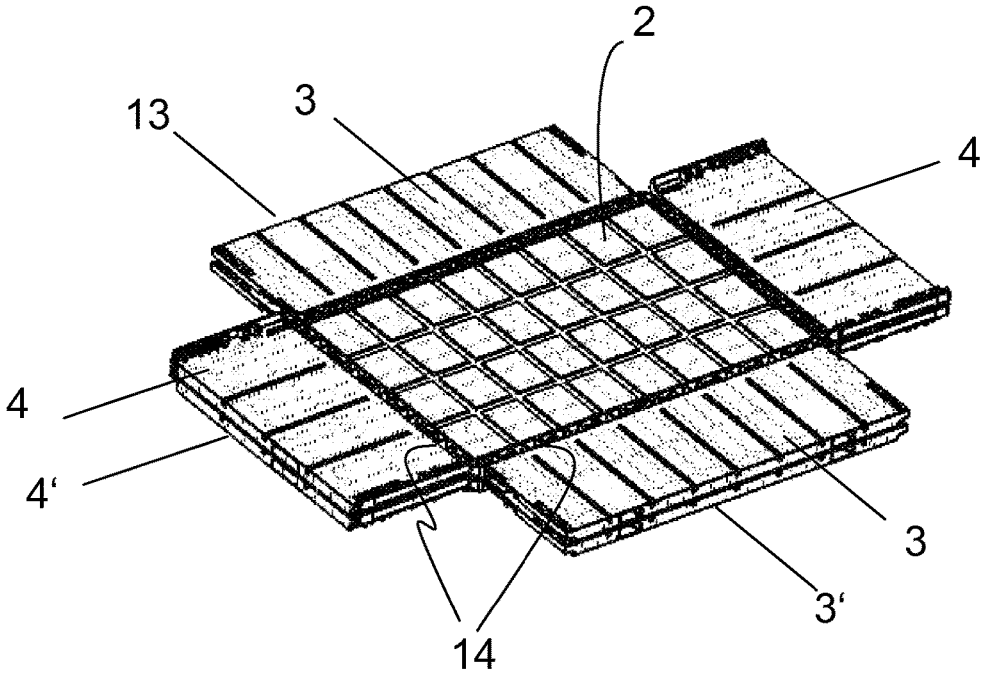
FIG. 2 shows a perspective view of two outwards folded containers in accordance with the invention, which are stacked on top of one another.

FIG. 1 shows the completed, operational container 1 according to the invention with a base 2 and upward folded lateral walls 3 and 2, with walls 3 herein referred to as short lateral walls and the walls 4 as long lateral walls, whereas equal length walls are definitely possible. In order to be able to save volumes during transport, the container according to the invention can be unfolded into the shape as seen in FIG. 2, with all of the lateral walls folded outward and forming one surface with the base. Any number of containers can be stacked in this shape as is shown with two containers here, with lateral walls 4 positioned on lateral walls 4' and lateral walls 3 positioned on lateral walls 3'.

Figure 3A:
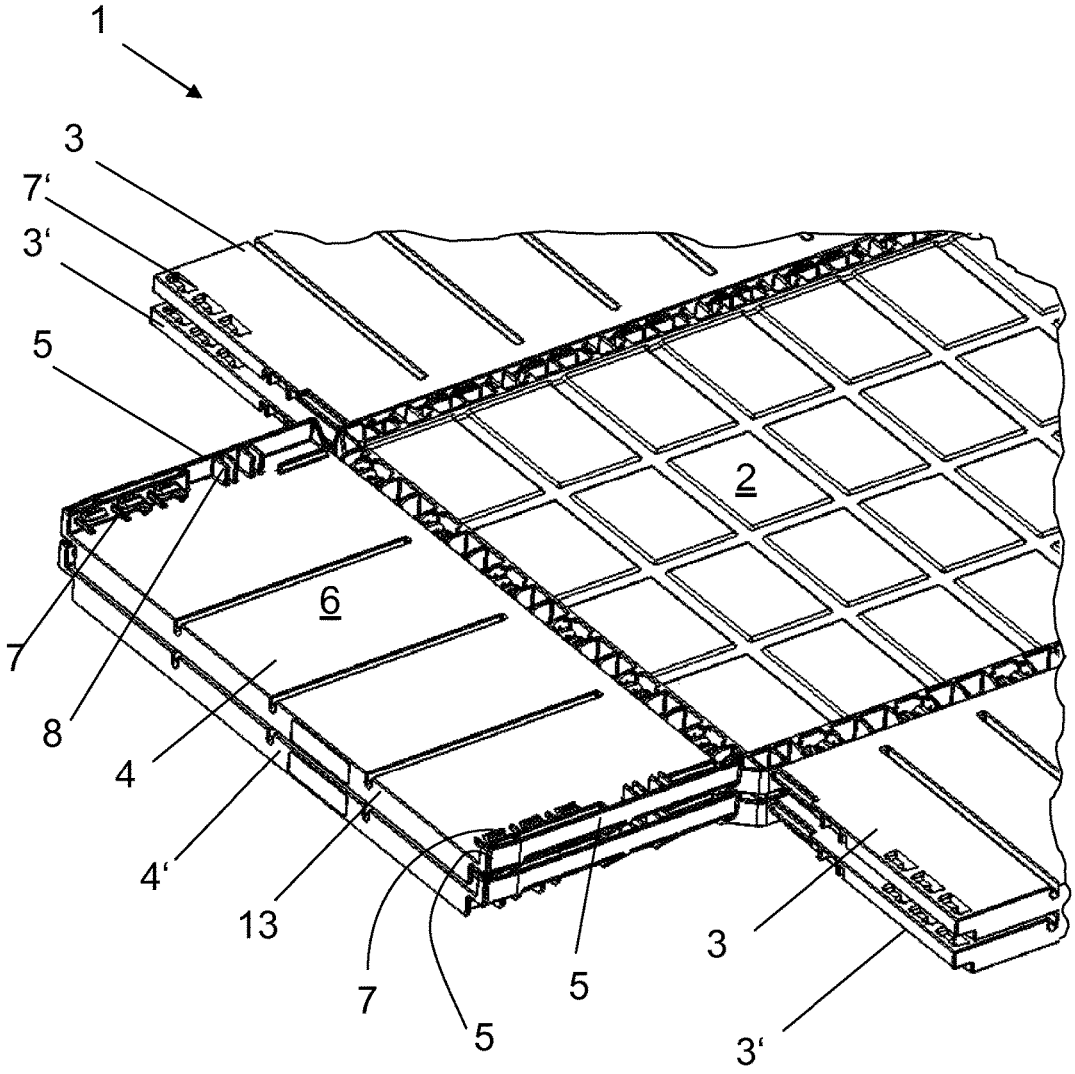
FIG. 3*a* displays two outwards folded containers that are stacked on top of one another and in particular a detail view from above the lateral wall of the top container with the ridges in the area of the latching elements in accordance with the invention.

According to the invention, as shown in FIG. 3*a*, the short lateral walls 4 of the container 1 feature protruding, step shaped trailing edges 5, with each protruding from the internal surface 6 of the lateral wall 4, with these extending in the displayed embodiment from the lateral wall 4 in the type of an overhanging cantilever arm and then vertically from the internal surface 6 and the end of the cantilever arm. The trailing edges 5 thus feature a cross section in a kind of step. With a folded container, the internal surface of a lateral wall is always that surface that faces the interior of the container. Correspondingly, the external surfaces are always those surfaces of the lateral walls that face to the outside in a folded container. Latching elements 7 are arranged on the trailing edges 5, with these facing the internal surface 6 of the lateral wall. These facilitate an interlocking of the short lateral walls 4 with the long lateral walls 3 with corresponding elements 7', with the lateral walls 3 and 4 brought into the vertical. During stacking, the unfolded containers can be stacked into each other thanks to the step shaped embodiment of the trailing edges, where the lateral walls of a container of a certain thickness can always be positioned between the trailing edges of the lateral walls of a container that is underneath this container as shown in FIG. 3*a*.

Figure 3B:
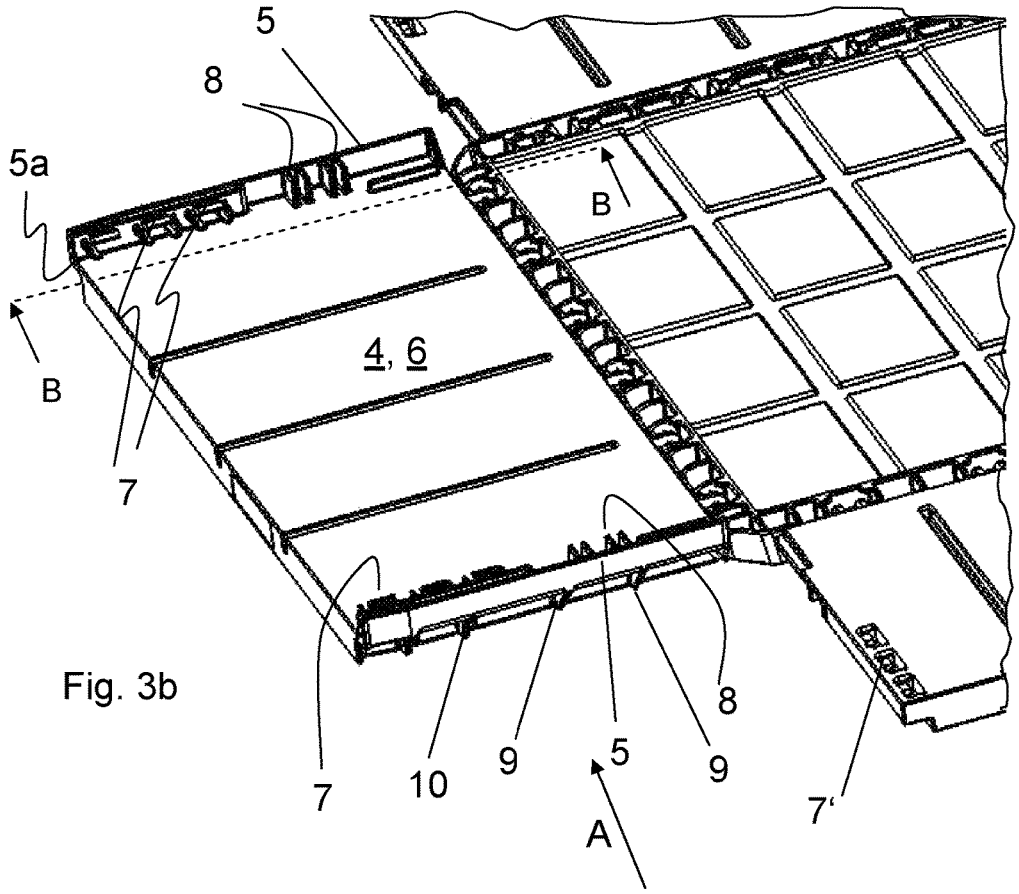
FIG. 3*b* shows a more detailed view of the ridges from above the top container in FIG. 3*a*.
Figure 3C:
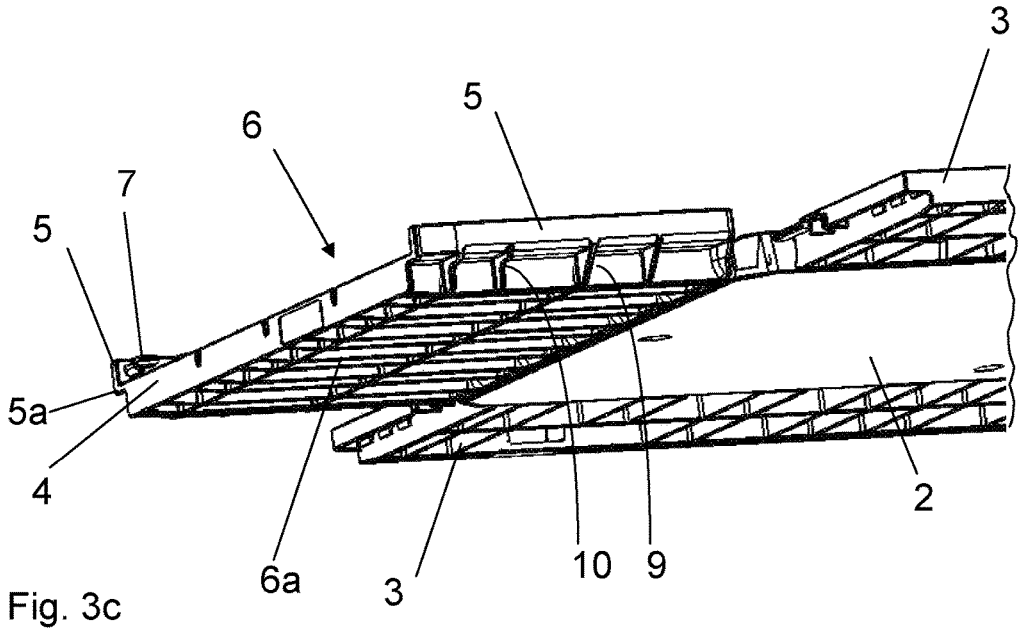
FIG. 3*c* shows a perspective view of the ridges on one of the lateral walls from below in accordance with the direction of arrow A in FIG. 3*b*.

FIGS. 3*b* and *c* show the short lateral wall 4 of a container 1 in a more detailed view, in particular with one or more ridges 8 on both trailing edges 5 of a lateral wall 4, with the ridges extending vertically from the trailing edge 5 in direction of the internal surface 6 of the lateral wall 4 and pointing toward each other. One or more ridges 9 are also arranged at the external surface 6*a* of the lateral wall 4, specifically at the lateral edges of the lateral wall which extend away from the bottom side of the cantilever arm 5*a* of the trailing edge 5. The ridges 9 are particularly beveled or supplied with a round notch as shown in FIG. 3*c*.

Figure 3D:
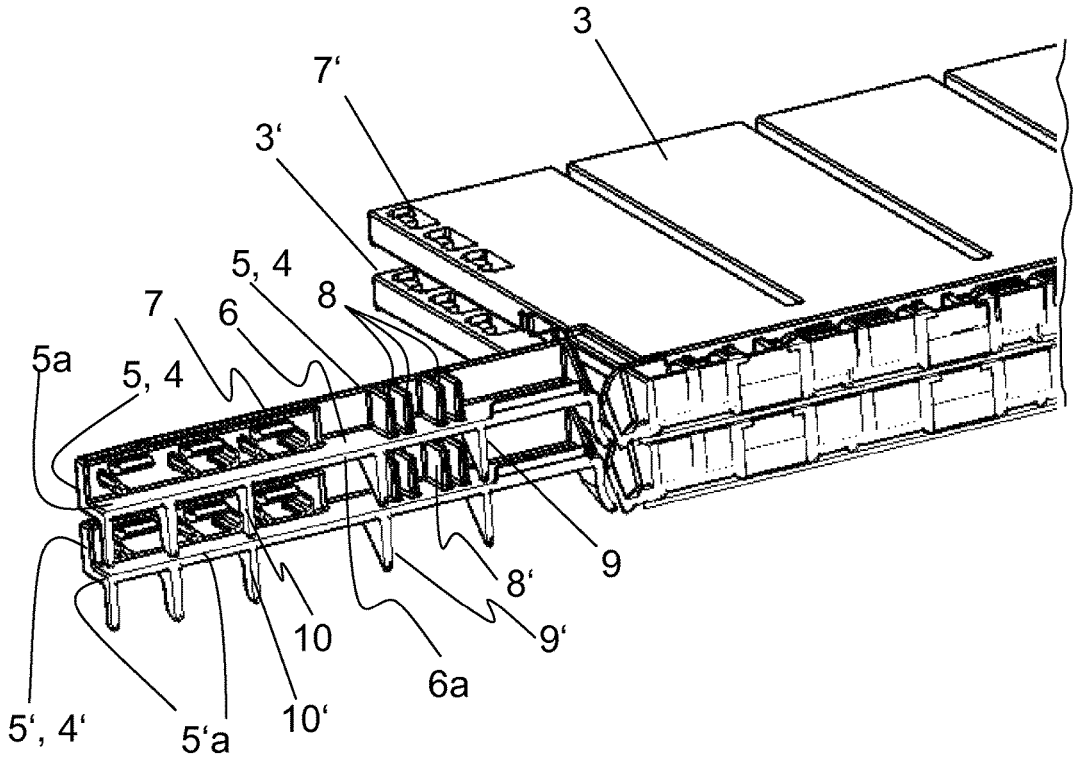
FIG. 3*d* shows a sectional view of the outward folded container in accordance with B-B in FIG. 3*b* and another identical container stacked on top of it and in particular the interlocking of the ridges of the two containers stacked on top of one another.

FIG. 3*d* shows the stacking of two containers with lateral walls 4 and 4' in cross section, with the ridges 8 and 9 interlocking in the trailing edges 5 and 5'. The stacking of the containers is made possible by the structurally supporting cantilever arms 5*a* of the trailing edges 5, due to which the containers can be stacked inside of one another as with a type of stacking chairs. The ridges 8 and 9 effect a fixation of the relative position of containers in this type of stacking and therefore prevent a shifting of the stack parallel to the trailing edge 5 of the lateral wall 4. A correct stacking is guaranteed by this and this makes it possible for a robot to manipulate the containers from the stack.

Additional ridges 10 are arranged at the bottom side of the cantilever arm of the trailing edges 5, 5' at the level of the latching devices 7. These engage between the latching devices 7 during the stacking of two containers. These effect an additional fixation of the containers in the stack and prevent a relative shifting of the containers, meaning parallel to the long lateral walls 3, 3'.

Because of the trailing edges 5, 5' that protrude from the surfaces 6 of the lateral walls 4, a fixation of the relative position of the stacked containers also results in diagonal direction or in a parallel direction to the short lateral wall 4, 4'.

Figure 4A:
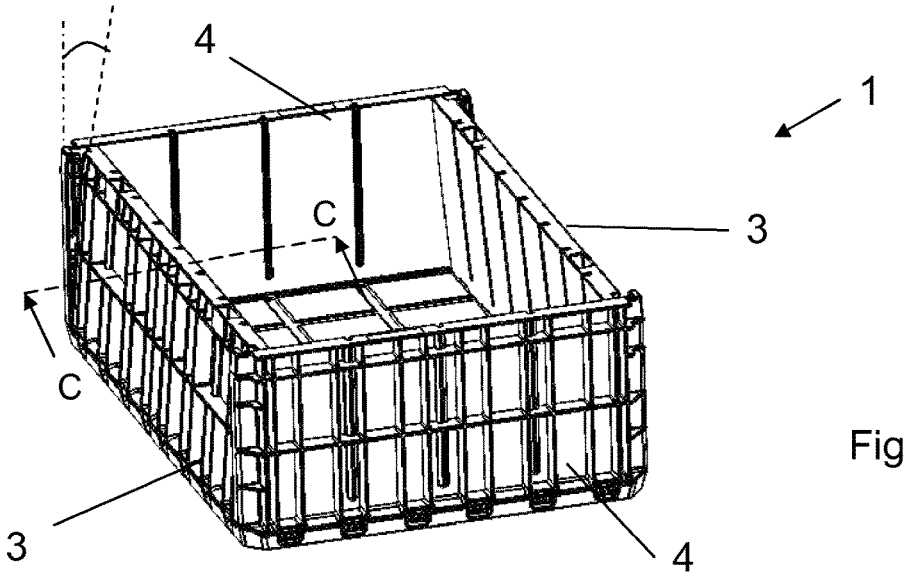
FIG. 4*a* displays the container in accordance with the invention during folding up of the lateral walls in a position beyond the vertical.
Figure 4B:
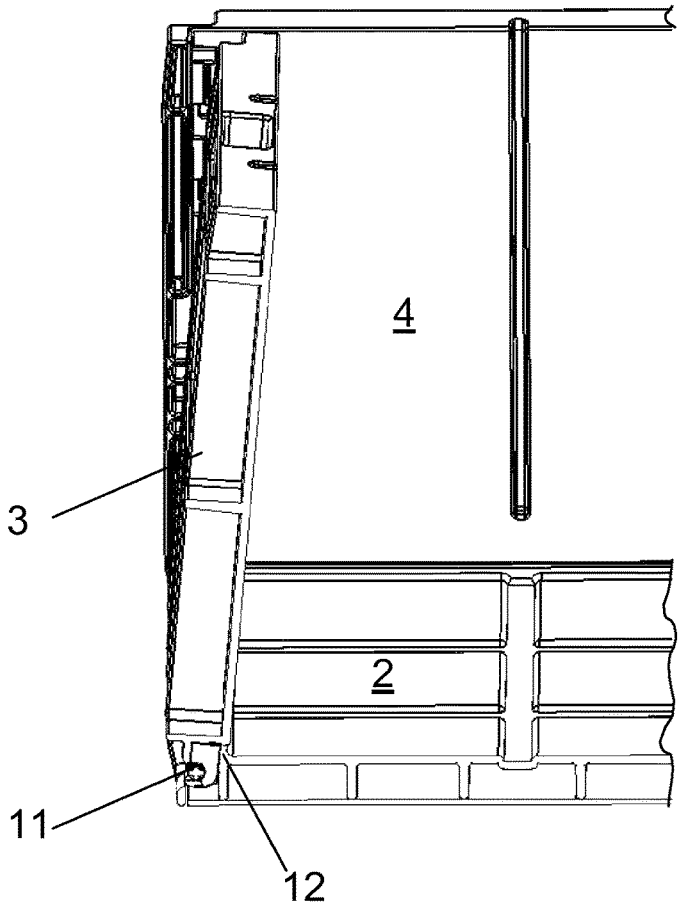
FIG. 4*b* displays a section in accordance with C-C in FIG. 4*a*, in particular the hinge area in the diagonal view of FIG. 4*a*.

FIG. 4 shows the container during the folding up of the lateral walls 3 and 4. In order to also facilitate an interlocking in the case that rigid materials that are not bendable are used for the container, hinges are designed at the base 2 and on the long lateral walls 3 in such a way that the long side walls 3 can be swiveled into vertical position and beyond the vertical into the interior of the container by an alpha angle such as 5° to 10°. The base 2 features an extension 12 for this in the area of the hinge 11, which protrudes vertically from its surface. The long lateral wall 3 then butts against this extension, which determines the angle position relative to the vertical. Therefore erection of the lateral walls and latching in this angle position can also be performed by a robot. The long lateral walls are first brought into this angle position relative to the vertical. The short lateral walls 4 are subsequently brought into the vertical and the long lateral walls are then brought back into the vertical and interlocked with the short lateral walls.

While the present invention has been illustrated and described with respect to a particular embodiment thereof, it should be appreciated by those of ordinary skill in the art that various modifications to this invention may be made without departing from the spirit and scope of the present.

I claim:

1. A foldable container with a base and four movable lateral walls that are connected to the base, which can be stacked and transported in a flat, outwardly unfolded condition, where the lateral walls can be swiveled from the outside to the inside, with the lateral walls each featuring an external and internal surface as well as two lateral edges and a top edge and a lower edge, with hinges arranged on the bottom edge of the lateral walls, by means of which the lateral walls can be folded upward from a flat orientation with the base and from horizontal position, and with the lateral edges of the lateral walls featuring latching elements for fixation of the upward folded lateral walls that are positioned at right angles to each other wherein:

the container comprises, on the lateral edges of at least two lateral walls opposite each other, a step shaped edge exhibiting a cantilever arm overhanging from the inside surface of the lateral walls and in the plane of the inside surface of the lateral wall and an edge protruding perpendicularly from the end of the cantilever arm and extending toward the inside of the container when the container is folded, with one or more protruding latching elements arranged on said step shaped edge pointing toward the inside surface of the lateral wall and with the container either featuring one or more ridges, which extend perpendicularly from the overhanging cantilever arm of the lateral wall and from the lateral edges of the lateral wall and toward the exterior of the container and are arranged to interlock with latching elements when two or more containers are stacked when unfolded or the container featuring one or more ridges, wherein some ridges extend from the cantilever arm toward the inside of the container when the container is folded and to the inside surface of the lateral wall and the other ridges extend at right angles away from the lateral edges of the lateral wall and toward the exterior of the container and are arranged to interlock with each other when two or more containers are stacked when unfolded.

2. The foldable container according to claim 1 wherein:

at least one latching element of the protruding latching elements is arranged on the protruding edge of the lateral wall and one or more of the ridges are arranged on the lateral edges of the lateral wall and one or more of the ridges are arranged in an area next to a latching element of the protruding latching elements or in the area between two latching elements of the protruding latching elements.

3. The foldable container according to claim 2 wherein:

the one or more latching elements are arranged on the protruding edge and extend parallel to the internal surface of the lateral wall, with the one or more ridges featuring a length and width equal to or approximately equal to the length and width dimensions of a latching element.

4. The foldable container according to claim 1 wherein:

one or more first ridges are arranged extending at right angles away from the cantilever arm and at right angles to the inside surface of the lateral wall;

and one or more second ridges are arranged extending away from the overhanging cantilever arm and at right angles to the lateral edges of the lateral wall, with the first ridges and the second ridges being offset against each other and arranged close to each other.

5. The foldable container according to claim 1 wherein:

the ridges extending from the lateral edges of the lateral wall taper in the direction of the end of the edge of the lateral wall.

6. The foldable container according to claim 5 wherein:

the tapering ridges are designed beveled or feature a rounded or angular notch.

7. The foldable container according to claim 1 wherein:

the hinge of the container for swiveling of the lateral walls is designed with a swivel range to bring the lateral walls into a position of up to 10° beyond the vertical position in terms of the interior of the container.

8. The foldable container according to claim 7 wherein:

a protruding extension is arranged on the base along the hinge.

* * * * *